US006152790A

United States Patent [19]

Morris

[11] Patent Number: 6,152,790

[45] Date of Patent: Nov. 28, 2000

[54] BIFURCATED CONTACT WITH A CONNECTING MEMBER THAT CAN ADD REDUNDANT CONTACT POINTS TO SINGLE POINT CONNECTORS

[75] Inventor: Terrel L. Morris, Garland, Tex.

[73] Assignee: Hewlett-Packard Company, Palo Alto, Calif.

[21] Appl. No.: 09/422,813

[22] Filed: Oct. 21, 1999

[51] Int. Cl.[7] ..... H01R 4/48

[52] U.S. Cl. ..... 439/862

[58] Field of Search ..... 439/862, 816, 439/891, 637, 80, 81, 83

[56] References Cited

U.S. PATENT DOCUMENTS 3,131,017 4/1964 Mittler ..... 439/862

3,382,575 5/1968 Gannoe ..... 439/862

4,017,143 4/1977 Knowles ..... 339/221 R 5,458,510 10/1995 Nager, Jr. et al. ..... 439/733.1

5,556,306 9/1996 Lin et al. ..... 439/637

*Primary Examiner*—Paula Bradley

*Assistant Examiner*—Phuongchi Nguyen

*Attorney, Agent, or Firm*—Steven L. Webb

[57] ABSTRACT

A connector with multiple redundant contact points that can withstand surface imperfections during card insertion is disclosed. One implementation is a bifurcated contact with a joining member at the tip of the contact that can be added onto a single point connector designs.

8 Claims, 6 Drawing Sheets

BIFURCATED CONTACT WITH A CONNECTING MEMBER THAT CAN ADD REDUNDANT CONTACT POINTS TO SINGLE POINT CONNECTORS

RELATED APPLICATIONS

The application "A bifurcated contact with a connecting member at the tip of the contact that provides redundant contact points" that is Ser. No. 09/422,875; is related to this application and is hereby incorporated by reference. The application "A connector with redundant contact points" Ser. No. 09/422,879 is also related to this application and is hereby incorporated by reference. Both the above referenced applications were filed on the same day as this application.

FIELD OF THE INVENTION

The present invention relates generally to connectors and more specifically to an edge connector with multiple redundant contact points that can be added onto a single point connector design.

BACKGROUND OF THE INVENTION

Personal computers come with many standard features, however some features are not shipped with all personal computers. A user can add additional capabilities to a computer by installing additional printed circuit (PC) boards, (sometimes referred to as daughter cards) into the computer. These daughter cards are typically added by installing the daughter cards into edge connectors that are mounted on the main processor board (motherboard) of the personal computer. The daughter cards (102) typically have pads (104) along the edge of the board that make contact with the individual contacts (106) in the edge connector (108). These connections between the pads (104) on the daughter card and the contacts (106) in the edge connectors serve as the electrical connection between the computer motherboard and the daughter cards. The edge connectors make the electrical connection to the plated area, or pad (202), on the daughter card (208) by providing an exerting force (206) (sometimes referred to as the normal force) to the contact (204) to push the contact firmly against the pad (see FIG. 2). Unfortunately edge connectors have a number of problems that affect the reliability of the connections between the pads and the contact points in the edge connector.

One problem is that the pads on the daughter card can get dirty. This can affect the connection in two ways. First, the pads can be covered or splattered with a contaminant that forms a thin film. If the film is not displaced by a wiping action as the daughter card is inserted into the edge connector, the film can prevent the contact from touching the pad and making electrical connection with the pad.

The amount of force or contact pressure between the pad and the contact point is a delicate balance between contact area and the normal force. When the contact area is relatively small with respect to the normal force, the contact pressure is high, and the contact can rip or wear plating from the surface of the pad. When the contact area is relatively large with respect to the normal force, the contact pressure is low, and the contact can fail to displace or wipe off the insulating surface contaminants, resulting in contact failure. Unacceptably high insertion force can result when a connector has a large number of contacts and a high normal force at each contact. Some edge connector applications, for example a test fixture, require a high number of insertion cycles over the life of the connector. In these applications a low normal force is desired to minimize the wear on the contacts and pads to extend the life of the connector. Today, typically a normal force of approximately 10 grams per contact is considered a low normal force and approximately 100 grams per contact is considered a high normal force.

Second, when the dirt on the daughter card is in the form of particles, the particles can wedge between the contact and the pad, lifting the contact away from the pad and preventing electrical connection to the pad. Other problems that can occur with edge connectors include plating defects on the pads, poor alignment of the contacts to the pads, and susceptibility to thermal changes, due to contact movement on the pad surface.

These problems are indicative of a common characteristic of edge card connectors, a single point of contact between the connector and the pad surface on the daughter card. This extremely small single point of contact can be rendered ineffective by plating defects, surface contamination, excessive wear, poor alignment, and motion. The result is that the entire interconnection can fail due to a small problem at a critical point. Making multiple redundant contacts between the connector and the plated surface of the daughter card can reduce these problems. By providing at least two contact points for each connector pin the chance that a random localized particle, film, dust or other contaminant will be able to cause a connector failure has been greatly reduced.

There are a number of ways that multiple redundant contacts can be implemented. One way is to send one signal to two different contacts connected to two different pads. This method can be used without any changes to current connector design. Unfortunately this method reduces the total number of signals that can be sent through the connector. If each signal were sent over two contacts the total number of signals that can be sent through the connector would be cut in half. Sending each signal to two different pads also increases the capacitance for each signal reducing the maximum operational frequency for the connector.

Another method to implement multiple redundant contacts is to cut the end of the contact into two prongs (see FIG. 3). This method creates two contact points (302) on the same pad. By creating two contact points on one pad the number of signals sent through the connector is not reduced. Multiple contacts on one pad also reduce the overall contact resistance. The multiple contacts form a parallel circuit and the resistance of parallel circuits is a function of the resistance per element, divided by the number of elements. Unfortunately when localized surface imperfections are present on the daughter card and one or both of the split contacts snag the imperfection during card insertion, locally high stresses can be inflicted into one or both of the split contacts. This can result in catastrophic contact failure and permanent damage to the connector. Because the connector manufacturer only makes the connector half of the mating pair of connector/daughter card, the connector manufacturer can not prevent this problem by controlling for surface imperfections of the daughter card.

Edge connectors are used in a wide variety of applications in addition to personal computers. The descriptions using personal computers as examples are for clarity of understanding and are not meant to limit the invention to edge connectors in personal computers.

Edge connectors are typically produced with hard tooling. Hard tooling is typically costly to build. An edge connector design with redundant contacts that can be added onto a single point connector would leverage the use of the hard tooling for two connectors. Therefore there is a need for a multiple redundant contact that can withstand surface imperfections during card insertion and can be added onto a single point connector design.

SUMMARY OF THE INVENTION

The present invention is a connector with multiple redundant contact points that can withstand surface imperfections during card insertion. One embodiment comprises a bifurcated contact with a connecting member at the tip of the contact that can be added onto a single point connector.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

Figure 5:
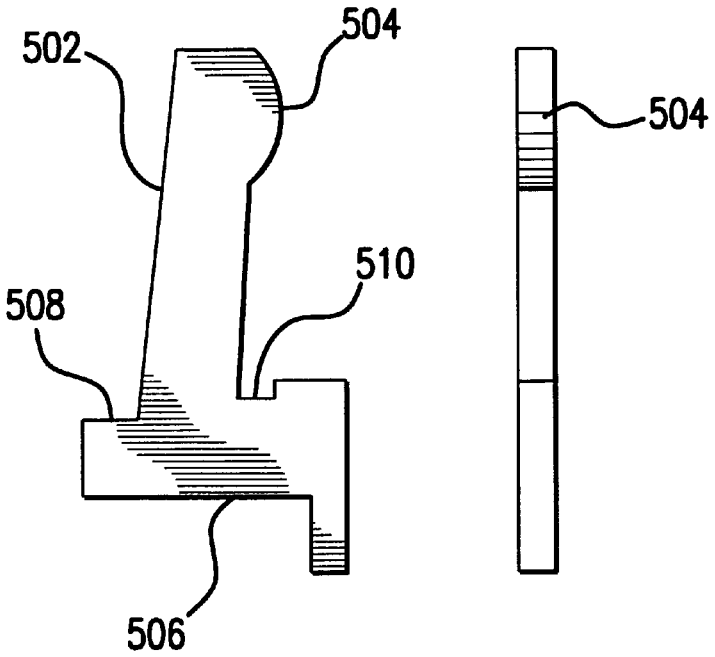
FIG. 5 is a drawing of a flat stamped contact made to accept a secondary contact in accordance with the present invention.

An edge connector with multiple redundant contact points that can withstand surface imperfections during card insertion can significantly increase the reliability of the connector. By providing a connector with multiple contacts that can be added onto a single point contact, for example a flat-stamped connector contact (see FIG. 5), the advantages of multiple contact can be obtained for a convertible connector design. The ability to add redundant contacts to a single point connector design allows a connector manufacture to create two connectors. The single point connector could be offered for applications that are more sensitive to cost and less sensitive to reliability. The multiple redundant connector can be offered for applications that are less sensitive to cost and place a premium on the reliability of the connection. By using the single point connector in both parts the manufacture can take advantage of the high volume/low cost of the single point design. By leveraging the single point connector it typically gives the manufacture the ability to produce a redundant contact connector for a lower overall tooling investment.

Figure 1:
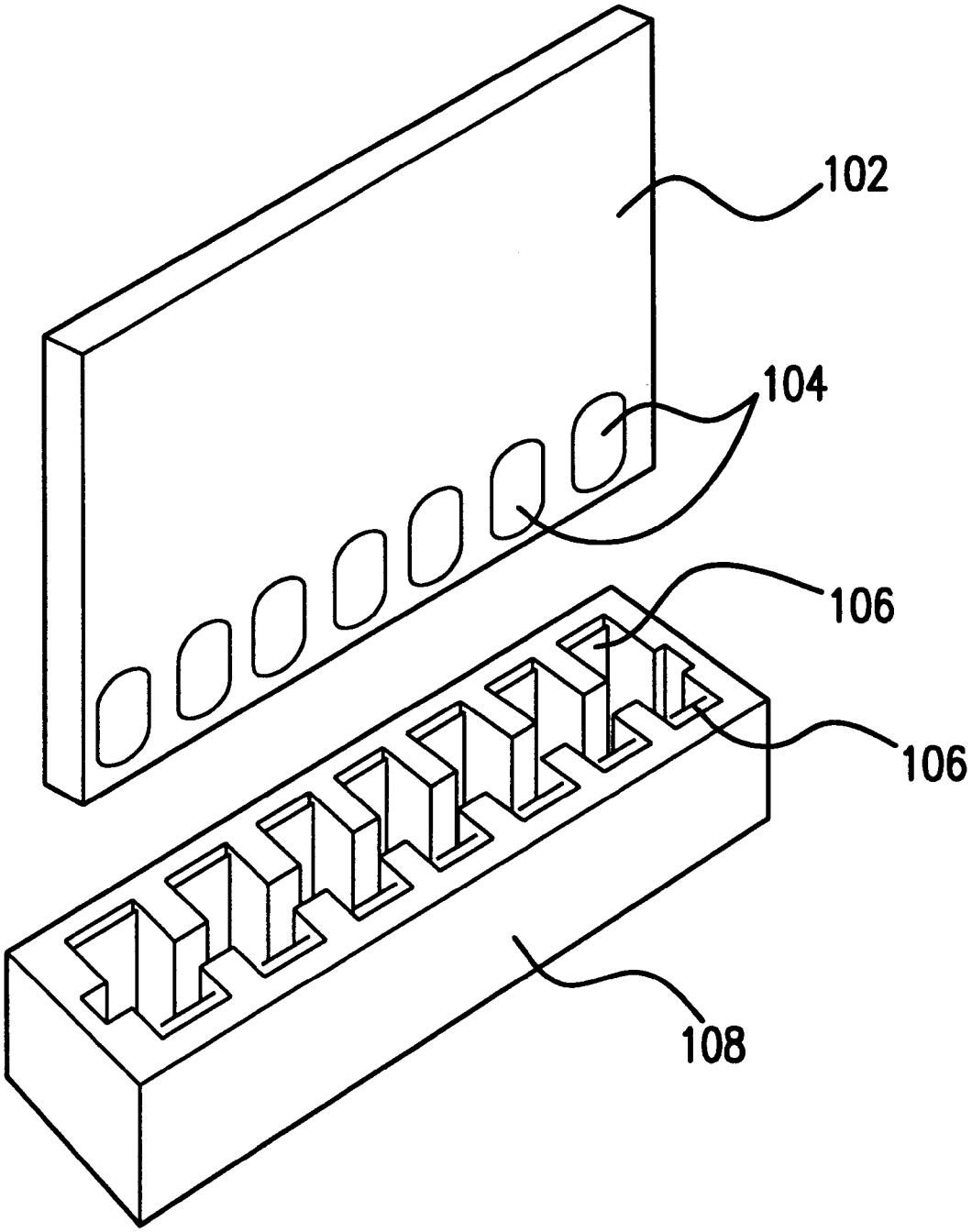
FIG. 1 is a projection view of an edge connector and a daughter card.
Figure 2:
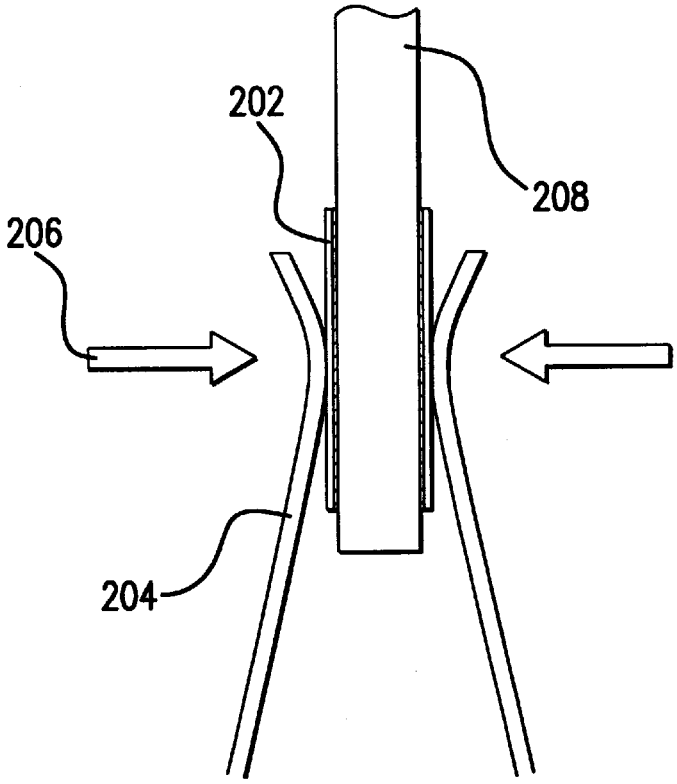
FIG. 2 is a force diagram of a daughter card inserted into an edge connector.
Figure 3:
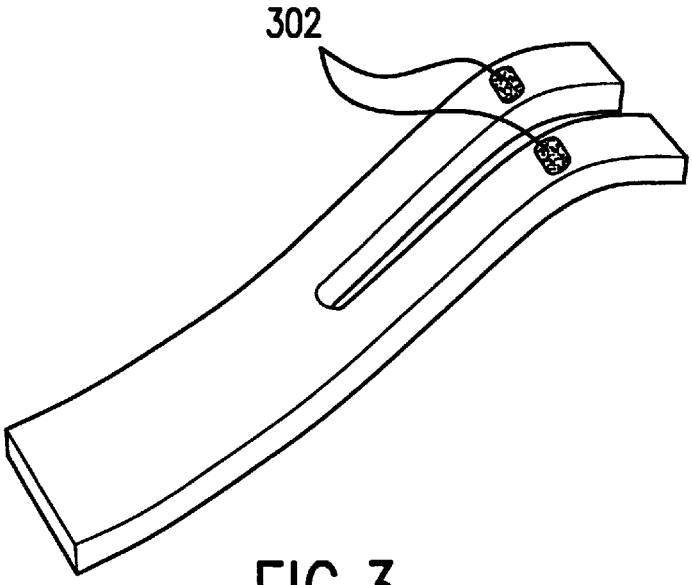
FIG. 3 is a projection view of a bifurcated contact from an edge connector.
Figure 4:
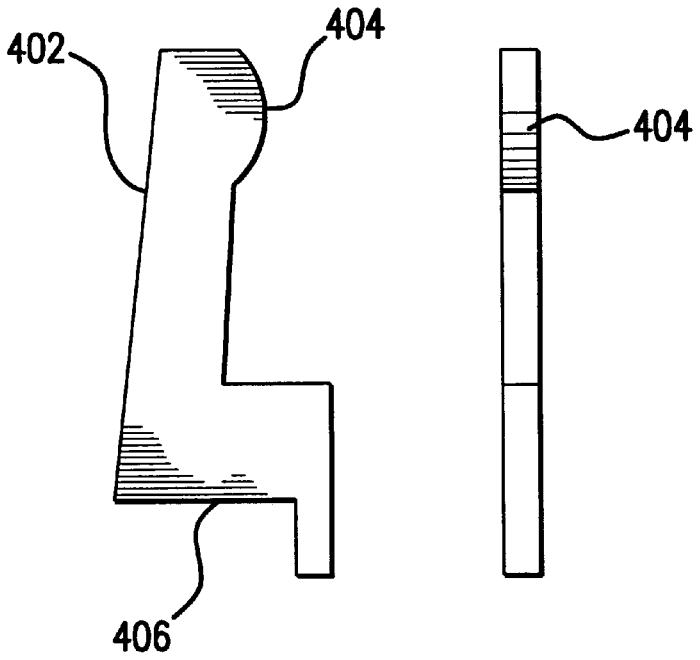
FIG. 4 is a drawing of a flat stamped contact.
Figure 6:
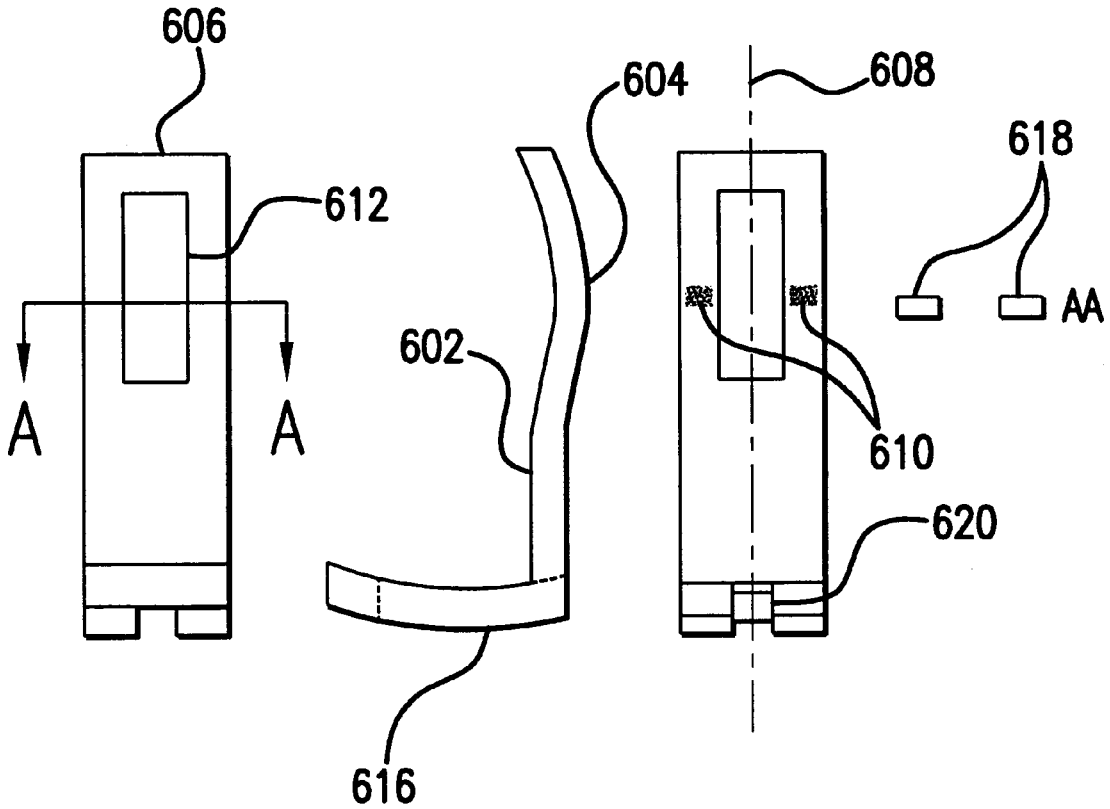
FIG. 6 is a drawing of a secondary beam with a bifurcated contact with a connecting member at the tip of the contact in accordance with the present invention.
Figure 6:
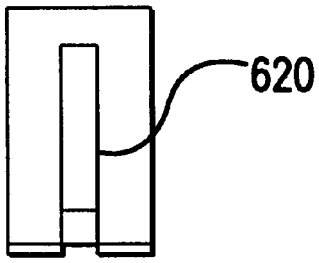

In one embodiment of the current invention there are two contact beams. The main contact (see FIG. 5) can be used as a single point contact connector. The main contact can also be used in conjuction with a secondary contact (see FIG. 6) to produce a multiple redundant contact connector. The main contact is a flat stamped contact (see FIG. 4) modified to accept a secondary contact.

The main contact comprises a main beam (502). The main beam (502) has a contact area (504) at one end of the main beam. The end of the main beam opposite the contact area is joined to a mounting structure (506). The mounting structure (506) has a retaining tab (508) on one side of the joined end of the main beam. The mounting structure and the main beam form a notch (510) opposite the retaining tab between the main beam and the mounting structure.

The secondary contact comprises a curved beam (602). The beam is curved to create a contact area (604). The curving also provides sufficient normal force to ensure a reliable connection at the contact area. The contact area is bifurcated to create two contact points (610). At the end of the secondary beam closest to the contact area the secondary beam has a joining member (606) that connects the two parts of the bifurcated beam. The joining member fully encloses the opening that bifurcates the contact area. In the preferred embodiment the shape of the fully enclosed opening (612) is a rectangle. The end of the secondary beam opposite from the contact area forms an appendage (616). The appendage is bent with respect to the secondary beam to provide a mechanism for generating a sufficient opposing force to the normal force needed at the contact points (610). The bent appendage pushes against the tab (508) of the main contact to produce the opposing force.

The bent appendage (616) forms a fully enclosed opening in the end of the bent appendage (620). In the preferred embodiment the opening is in the shape of a rectangle. The width of the opening (620) is such that the secondary beam will form a tab-in-slot interference fit when inserted into the notch in the main connector contact (see FIG. 7). An interference fit mechanism, for example knurling or skiving, can be used on the inside edge of the opening in the appendage to enhance the interference fit.

Figure 7:
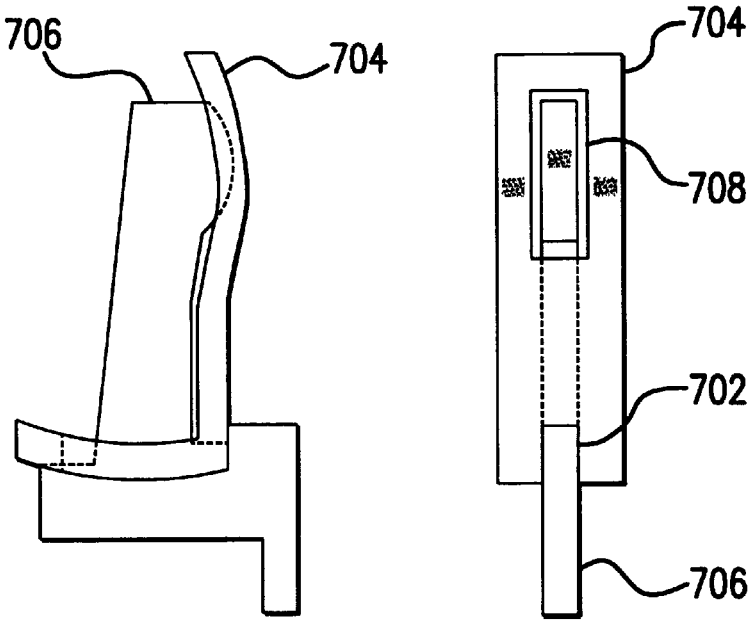
FIG. 7 is an assembly drawing of a secondary beam mounted to a main beam in accordance with the present invention.

FIG. 7 shows the assembly of the main contact with the secondary contact of one embodiment of the current invention. The opening (702) in the appendage in the secondary beam (704) is tab-in-slot press fit onto the main contact (706). The fully enclosed opening (708) in the contact area of the secondary beam allows the main contact to access the pad on the mating PC board.

The contact of the secondary beam functions as follows: When the contact points (610) on the secondary beam encounter surface contamination or debris on the plated area or pad of the daughter card, the secondary beam twists around axis 608 allowing both contact points to maintain a connecting force. When an extreme downward force along axis 608 is generated by insertion of a card with localized surface imperfections, the joining member (606) spreads the load between both bifurcated beams. This allows both bifurcated beams to carry the vertical loading, greatly reducing the tendency of one beam to fail under the high localized force.

Figure 8:
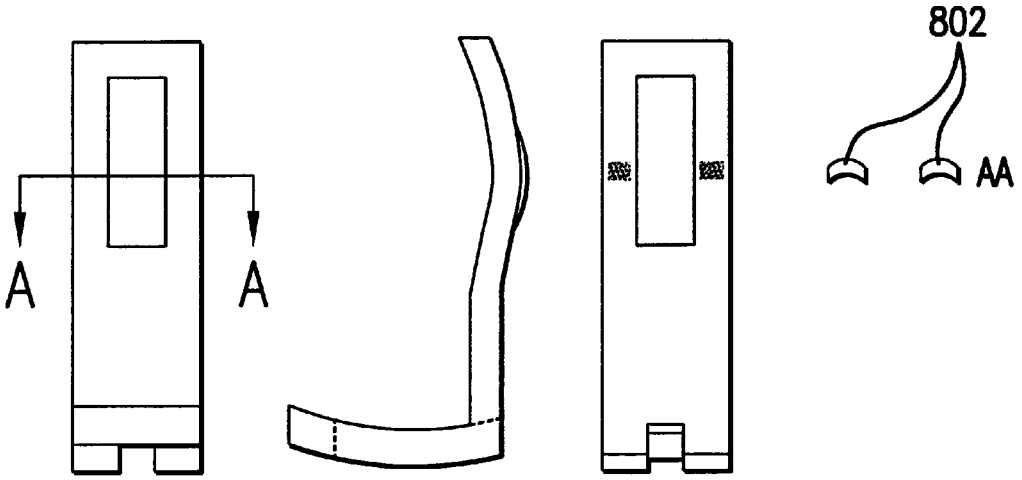
FIG. 8 is a drawing of a bifurcated contact with a connecting member at the tip of the contact where the contact areas have been formed in the shape of a hemisphere in accordance with the present invention.

The contact pressure of the contact points can be adjusted by changing the cross sectional shape in the contact area. A flat shape (618) would tend to maximize the contact area and produce the lowest contact pressure. A curved shape (see FIG. 8) would tend to minimize the contact area and produce high contact pressure. The contact areas (802) in the secondary beam can be coined or stamped and formed to produce a curved or hemispherical cross sectional shape in the contact areas (802). The width of the beam can also be curved to increase the stiffness of the beam. The width can be curved along part or all of the length of the beam.

Figure 9:
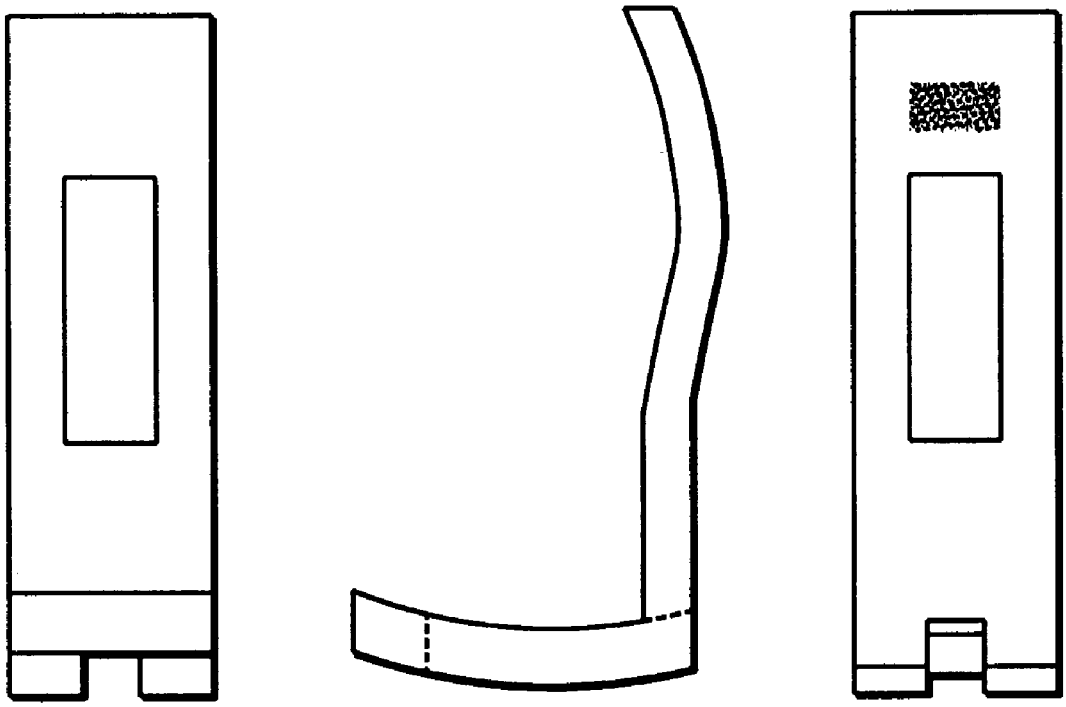
FIG. 9 is a drawing of a bifurcated contact with a connecting member at the tip of the contact, with the contact area on the joining tip of the contact, in accordance with the present invention.

The foregoing description of the present invention has been presented for purposes of illustration and description. It is not intended to be exhaustive or to limit the invention to the precise form disclosed, and other modifications and variations may be possible in light of the above teachings. For example, the contact area of the secondary beam can be moved forward (see FIG. 9) or backward beyond the fully enclosed opening. This would produce only one redundant contact point, instead of two redundant contact points for the multiple redundant contact. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A secondary contact, comprising:

a secondary beam, the secondary beam having a first end and a second end, the secondary beam is curved to form a contact area near the first end;

the first end of the secondary beam forms at least one fully enclosed opening;

the fully enclosed opening has a width, the width of the fully enclosed opening allows access of a main contact through the beam;

the second end of the secondary beam forms an appendage, the appendage is bent at a predetermined angle with respect to the secondary beam;

the appendage forms an second opening in the secondary beam, the second opening has a predetermined width, the width is predetermined to form an interference fit with the main contact.

2. The secondary contact of claim 1 where the fully enclosed opening, in the first end of the secondary beam, is in the shape of a rectangle.

3. The secondary contact of claim 1 where the contact points are approximately hemispherical.

4. The secondary contact of claim 1 where the secondary beam produces a high normal force.

5. The secondary contact of claim 1 where the secondary beam produces a low normal force.

6. The secondary contact of claim 1 where the inside edge of the second opening in the secondary beam is modified with an interference fit mechanism.

7. The secondary contact of claim 1 where the fully enclosed opening, at the first end of the secondary beam, divides the contact area into at least two parts.

8. The secondary contact of claim 7 where the parts of the contact area are of approximately equal size.

* * * * *